US005230492A

United States Patent [19]

Zwart et al.

[11] Patent Number: 5,230,492

[45] Date of Patent: Jul. 27, 1993

[54] SUPPORT BRACKET

[75] Inventors: Donald A. Zwart; Michael J. Veihl, both of Spring Lake; Lawrence J. O'Keefe, Grand Rapids; Michele D. Bekins, Comstock Park, all of Mich.

[73] Assignee: Integrated Metal Technology, Inc., Spring Lake, Mich.

[21] Appl. No.: 770,036

[22] Filed: Oct. 1, 1991

[51] Int. Cl.[5] ..... A47B 47/00

[52] U.S. Cl. ..... 248/222.1; 211/187; 248/243

[58] Field of Search ..... 248/220.2, 222.1, 231.9, 248/243, 245, 247; 211/187, 193

[56] References Cited

U.S. PATENT DOCUMENTS

| | | | |
|---|---|---|---|
| 3,294,351 | 12/1966 | Rollins, Jr. | 248/243 |
| 3,565,381 | 2/1971 | Oliver | 248/243 |
| 3,570,798 | 3/1971 | Squibb | 248/243 X |
| 3,966,158 | 6/1976 | Boundy | 248/243 |
| 4,700,916 | 10/1987 | Bastian et al. | 248/243 X |
| 4,971,281 | 11/1990 | Steinbeck | 248/222.1 X |

FOREIGN PATENT DOCUMENTS

| | | | |
|---|---|---|---|
| 286689 | 11/1967 | Australia | 248/243 |

*Primary Examiner*—David A. Scherbel
*Assistant Examiner*—Derek J. Berger
*Attorney, Agent, or Firm*—Willian Brinks Olds Hofer Gilson & Lione

[57] ABSTRACT

A bracket assembly includes a first bracket having a plurality of spaced apart anchor members extending outward therefrom for insertion into a plurality of corresponding apertures in a vertical member of a wall panel, and a second bracket having a plurality of spaced apart anchor members extending outward therefrom for insertion into a plurality of corresponding apertures in the vertical member. The anchor members are adapted to cooperate with the vertical member to restrain the corresponding bracket from horizontal movement. Locking means are adapted to move one of said brackets relative to the other such that the anchor members cooperate with the vertical member to secure the bracket assembly thereto.

22 Claims, 5 Drawing Sheets

Fig. 1
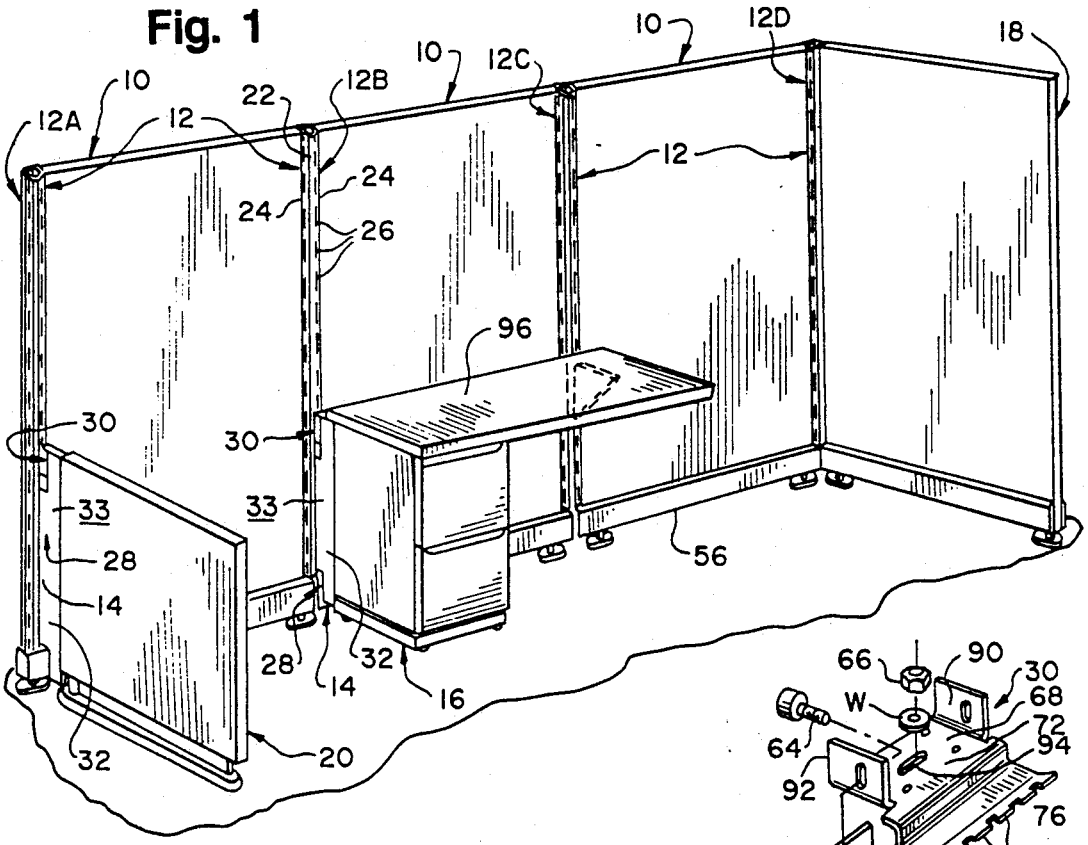
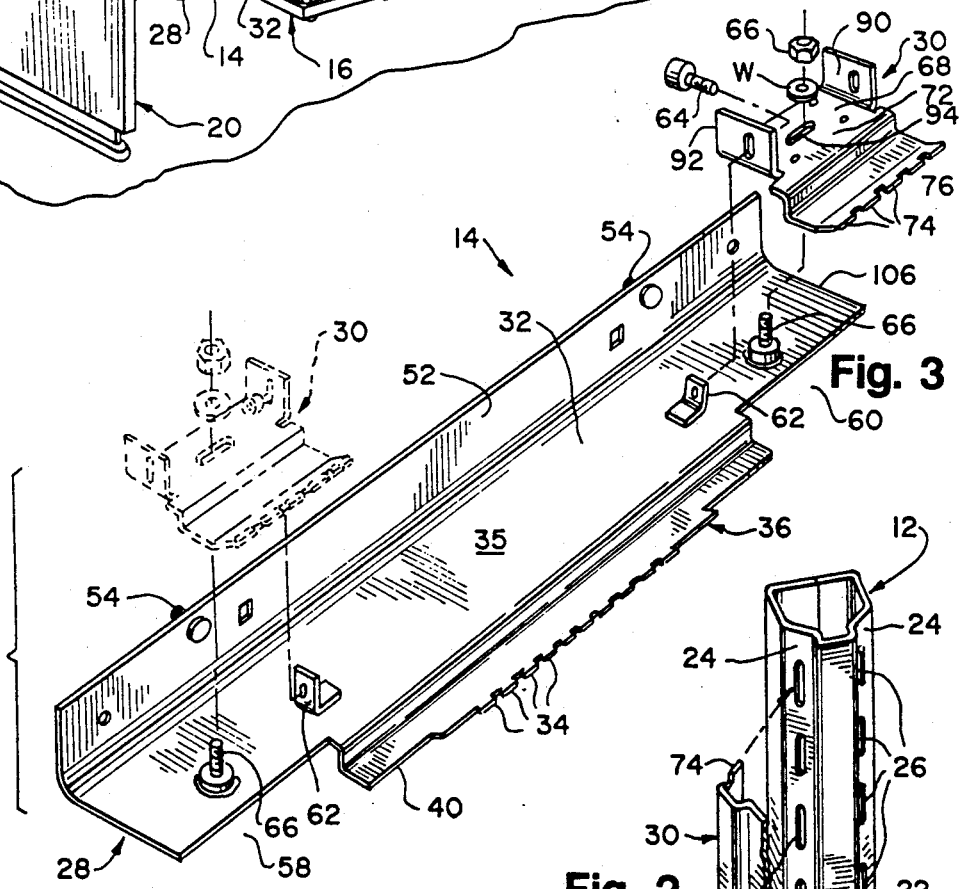
Fig. 3
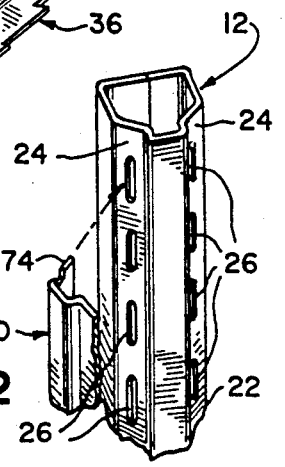
Fig. 2

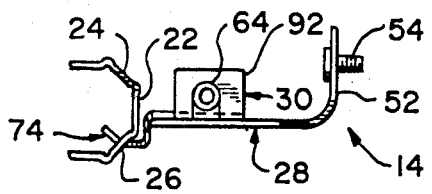
Fig. 7
Fig. 6
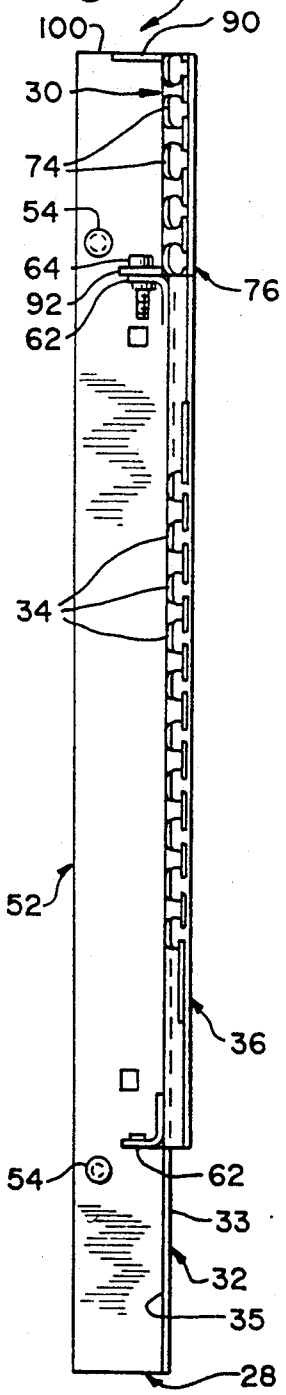
Fig. 4
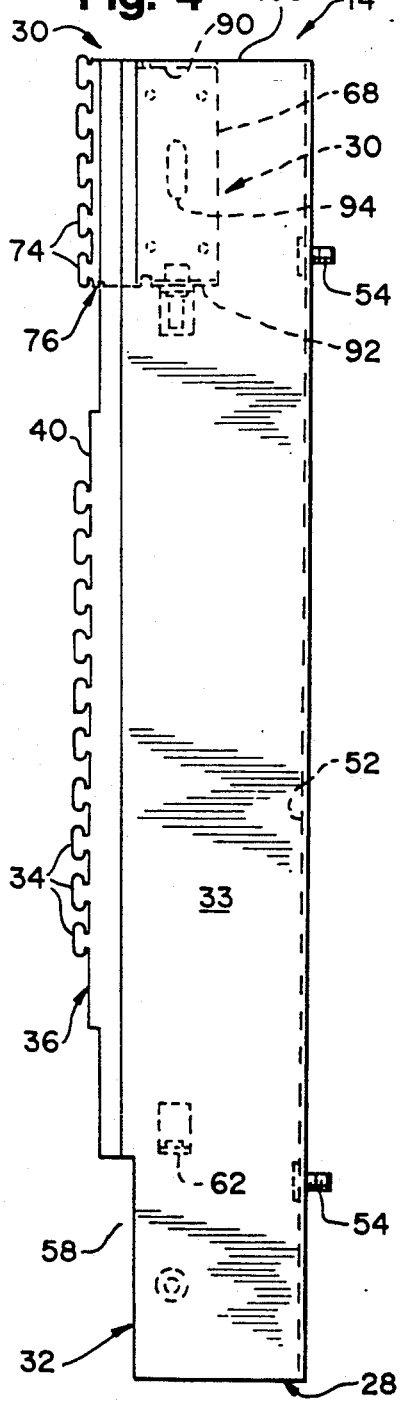
Fig. 5
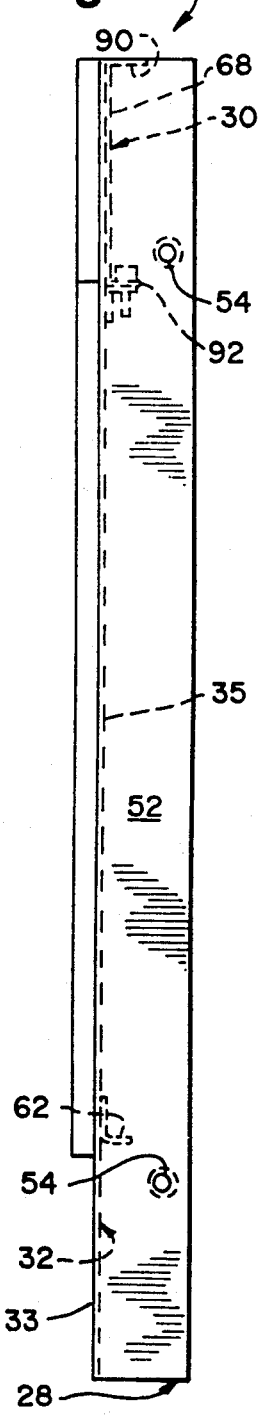

SUPPORT BRACKET

BACKGROUND OF THE INVENTION

The present invention relates generally to support brackets, and more particularly, to a bracket assembly which is securely mounted to a wall panel for attaching a pedestal or the like thereto.

In conventional wall panel systems, support panels and/or pedestals are mounted to a desired vertical member of a wall panel system to support the wall panels and provide a mounting surface for worksurfaces or the like. The support panels and pedestals are generally mounted to the vertical members by a support bracket which is secured to the vertical member by placing downwardly extending hooks thereof into a plurality of oversized slots formed in the vertical member. Since the slots are larger than the hooks, the support bracket tends to be loosely attached to the vertical member and is moveable in an upward and lateral direction.

SUMMARY OF THE INVENTION

A bracket assembly includes a first bracket having a plurality of spaced apart anchor members extending outward therefrom and a second bracket having a plurality of spaced apart anchor members extending outward therefrom. The anchor members of the first and second bracket are inserted into a plurality of corresponding spaced apart apertures in a vertical member of a wall panel and are adapted to cooperate with the vertical member to restrain the corresponding bracket from horizontal movement. Locking means are adapted to move one of said brackets relative to the other such that the anchor members cooperate with the vertical member to secure the bracket assembly thereto.

In a preferred embodiment, the bracket assembly includes an upper and lower bracket which is used with a wall panel vertical member having a plurality of vertically aligned, longitudinal slots therein. The upper and lower brackets include a vertical plate positioned perpendicularly to the wall panel. A plurality of vertically aligned, spaced apart anchor members extend horizontally outward from a vertical edge portion of the lower bracket vertical plate for insertion into a plurality of lower slots in the vertical member of the wall panel. Likewise, a plurality of vertically aligned, spaced apart anchor members extend horizontally outward from a vertical edge portion of the upper bracket vertical plate for insertion into a plurality of upper slots in the vertical member of the wall panel.

Preferably, the upper bracket anchor members comprise a horizontal neck portion and a hook portion extending downwardly therefrom, and the lower bracket anchor members comprise a neck portion and a hook portion extending upwardly therefrom. The hook portions have an inner edge parallel to and spaced apart from the edge portion of the corresponding bracket plate, and the distance between the hook portion inner edges and the edge portion of the corresponding bracket plate is substantially the same as the thickness of the vertical member of the wall panel to form a recess which slideably receives said vertical member.

The locking means is adapted to pull the upper and lower brackets vertically toward each other so that the wall panel vertical member is slideably received by the anchor member recesses and the hook members prevent horizontal movement of the bracket assembly. In addition, bottom edges of the upper bracket anchor member necks bear against bottom edges of the upper slots, and top edges of the lower bracket anchor member necks bear against top edges of the lower slots to prevent vertical movement of the bracket assembly. As a result, the bracket assembly is rigidly secured to the vertical member of the wall panel. Preferably, the locking means comprises a flange extending horizontally outward from a lower edge of the upper bracket vertical plate, a tab extending horizontally outward from the lower bracket vertical plate, and a threaded fastener coupling the flange and tab. To secure the bracket assembly to the wall panel vertical member, the upper and lower brackets are pulled toward each other by turning the fastener.

In addition, a substantial portion of the upper bracket plate preferably bears against one side of the lower bracket plate to conceal said portion from the view of a person on the other side of the lower bracket. A top edge of the upper bracket plate is approximately the same height as a top edge of the lower bracket after assembly, and a horizontal flange extends outward from the top edge for mounting a worksurface thereon.

The present invention provides significant advantages over other wall panel brackets. The bracket assembly is conveniently and securely mounted to the vertical member of the wall panel to provide a stable mounting bracket for support panels, pedestals, or the like, which in turn provides a better support for the wall panel system as a whole. In addition, the bracket assembly provides a secure mounting surface for a worksurface and has an attractive, uniform appearance.

The present invention, together with further objects and advantages, will be best understood by reference to the following detailed description taken in conjunction with the accompanying drawings.

BRIEF DESCRIPTION OF THE DRAWINGS

FIG. 1 is a perspective view of a preferred embodiment of the invention showing a plurality of interconnected wall panels, a support wall and support panel extending from vertical members thereof, a pedestal mounted to a bracket assembly, and a worksurface mounted to the pedestal.

FIG. 2 is a fragmentary, exploded, perspective view of an upper bracket and a vertical member of the wall panel.

FIG. 3 is a perspective view of a preferred embodiment of the invention showing the inside of a disassembled bracket assembly.

FIG. 4 is a front view of the bracket assembly viewed from outside the pedestal in FIG. 1.

FIG. 5 is a side view of the bracket assembly shown in FIG. 5.

FIG. 6 is an opposite side view of the bracket assembly shown in FIG. 5.

FIG. 7 is a top view of the bracket assembly in FIG. 4 shown connected to a vertical member of a wall panel.

DETAILED DESCRIPTION OF THE PREFERRED EMBODIMENTS

Figure 8:
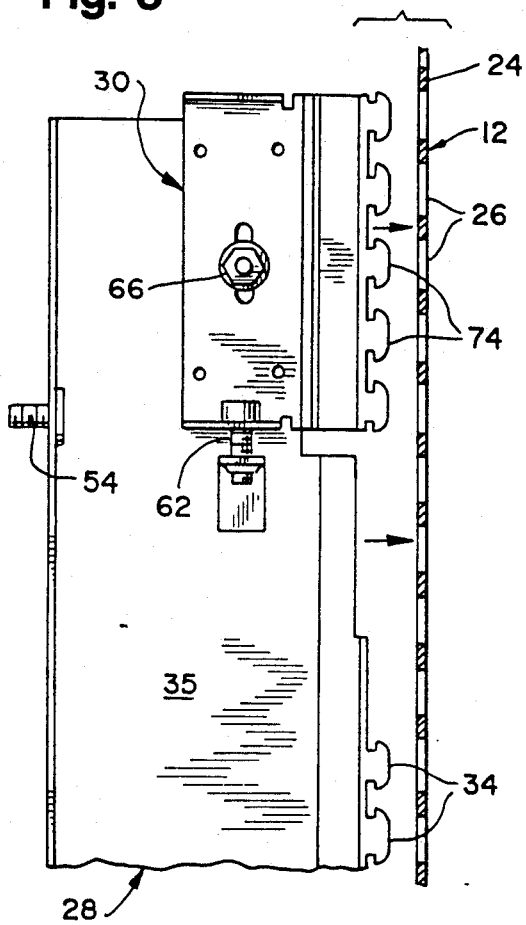
FIG. 8 is a fragmentary, exploded back view of the bracket assembly shown prior to the insertion of anchor members thereof into slots in the vertical member of the wall panel.

Referring to the drawings, FIG. 1 shows a plurality of wall panels 10 interconnected by a plurality of vertical members 12, including end members 12A and 12D and middle members 12A and 12B. A bracket assembly 14 is mounted to vertical member 12B to support a pedestal 16. The bracket assembly 14 can be mounted to any one of the vertical members 12, and any number of wall panels 10 can be arranged in a desired configuration to suit the needs of a particular office environment. For example, the bracket assembly 14 can be used with a panel system of a type described in U.S. patent application Ser. No. 07/596,352, filed Oct. 12, 1990, U.S. patent application Ser. No. 07/580,300, filed Sep. 10, 1990, or U.S. patent application Ser. No. 07/670,240, filed Mar. 15, 1991, the disclosures of which are specifically incorporated herein by reference.

The pedestal 16 can be mounted to a desired bracket assembly 14 at a desired location to support the wall panels 10. In addition, a full length support wall 18 or a support panel 20 of a type described in U.S. patent application Ser. No. 07/588,364, filed Sep. 25, 1990, the disclosure of which is specifically incorporated herein by reference, can be mounted to a desired bracket assembly 14 to support the wall panels 10.

As best shown in FIG. 2, the vertical members 12 preferably include a middle plate 22 and side plates 24 extending rearwardly at an angle relative to the front plate 22. The side plates 24 have a plurality of vertically aligned, longitudinal, spaced apart slots 26 therein. The slots 26 can be formed in the wall panel 10 itself, a vertical member having a single exposed plate, or any other suitably configured vertical member.

Referring to FIGS. 3-6, the bracket assembly 14 includes a lower bracket 28 and an upper bracket 30. The lower bracket 28 includes a vertical plate 32 having an outer surface 33, an inner surface 35, and a plurality of vertically aligned, spaced apart anchor members 34 extending horizontally outward from a vertical edge portion 36 thereof. The anchor members 34 are inserted through a plurality of lower slots 26 in one of the vertical member side plates 24. To allow the lower bracket plate 32 to extend perpendicularly from the wall panel 10, the edge portion 36 and anchor members 34 extend at an angle relative to the plate 32 such that the anchor members 34 are perpendicular to the vertical member side plate 24. In addition, the edge portion 36 is preferably stepped from the vertical plate 32 of the lower bracket 28.

Figure 14:
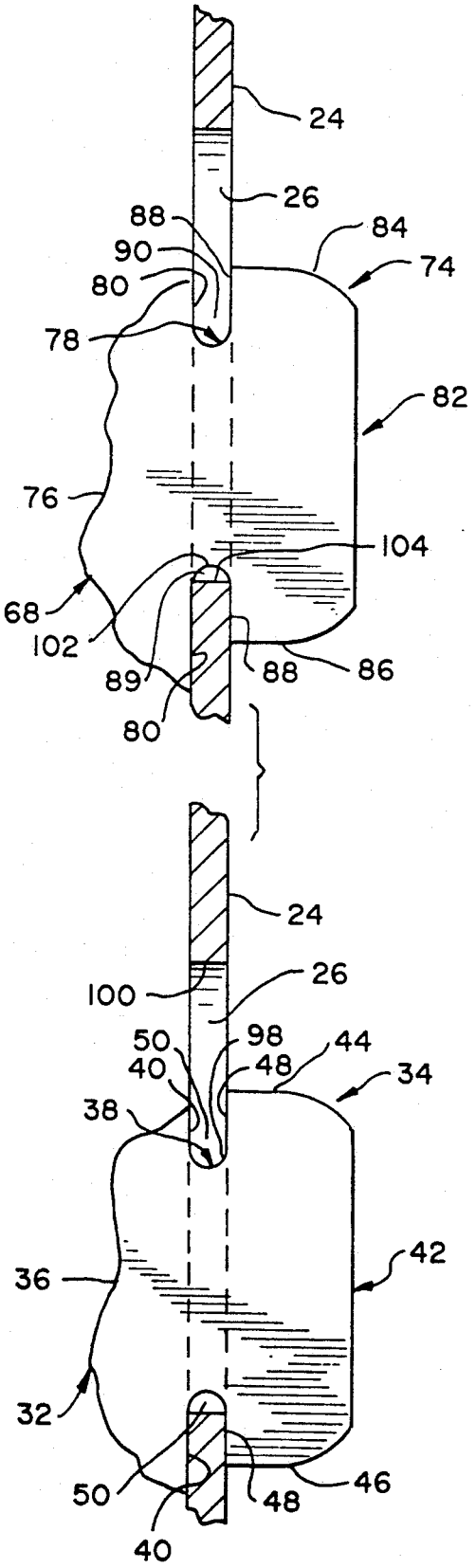
FIG. 14 is an exploded view of an upper bracket anchor member and a lower bracket anchor member shown after insertion into the corresponding slots in the vertical member of the wall panel.
Figure 15:
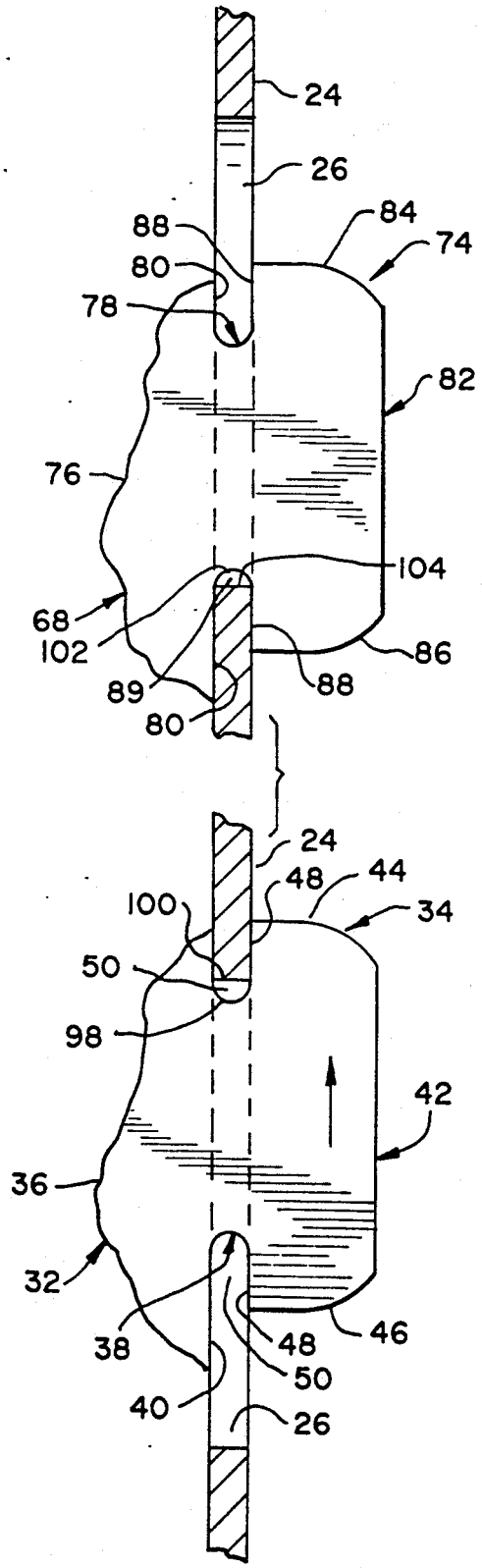
FIG. 15 is an exploded view of the upper and lower bracket anchor members shown after the locking means has pulled the lower bracket toward the upper bracket.

As best shown in FIGS. 14 and 15, the lower bracket anchor members 34 comprise a neck portion 38 extending horizontally outward from an edge 40 of the lower bracket plate 32 and a head 42 extending outwardly from the neck portion 38. The head 42 has an upwardly extending hook portion 44 and a downwardly extending hook portion 46. The anchor members 34 can comprise only an upwardly extending hook portion 44, although the downwardly extending hook portion 46 is desirable to allow the lower bracket to be inversely assembled to the opposite side plate 24 of the wall panel vertical member 12. The hook portions 44 and 46 have an inner edge 48 parallel to and spaced apart from the edge 40 of lower bracket plate 32, and the distance between the hook portion inner edges 48 and the edge 40 of the lower bracket plate 32 is approximately the same as the thickness of the vertical member side plate 24 to form a recess 50 which slideably receives the side plate 24.

Referring again to FIGS. 3-6, the lower bracket 28 also has a vertical flange 52 extending perpendicularly from the plate 32 to provide a mounting surface for attaching the pedestal 16, support panel 20, or other devices thereto. Fasteners 54 are provided for mounting the pedestal 16 to the flange 52. The lower bracket can be configured in any way which allows the pedestal 16, support panel 20, or any other device to be attached thereto. To provide clearance for a horizontal raceway 56 extending outward from a lower portion of the wall panels 10 (FIG. 1), a recess 58 is formed in a lower portion of the lower bracket plate 32. Preferably, a recess 60 is also formed in an upper portion of the lower bracket plate 32 to allow the lower bracket 28 to be inversely assembled to the opposite side plate 24 of the wall panel vertical member 12.

To fasten the upper bracket 30 to the lower bracket 28 and lock the bracket assembly 14 securely to the vertical member 12, a tab 62 extends horizontally outward from the inner surface 35 of the lower bracket vertical plate 32. The tab 62 has a threaded hole therein (not shown) for receiving a threaded fastener 64, such as a cap screw or the like. To further secure the upper bracket 30 to the lower bracket 28, a fastener 66 such as a bolt and nut extends horizontally outward from the inner surface 35 of the lower bracket vertical plate 32. The tab 62 and fastener 66 are preferably welded to the inner surface 35 of the lower bracket plate 32 so that the outer surface 33 appears smooth and attractive to a person viewing the outer surface 33.

The upper bracket 30 includes a vertical plate 68 having an outer surface (not shown), an inner surface 72, and a plurality of vertically aligned, spaced apart anchor members 74 extending horizontally outward from a vertical edge portion 76 thereof. The upper bracket is positioned adjacent an upper portion of the lower bracket 28, and a substantial portion of the upper bracket plate 68 bears against the inner surface 35 of the lower bracket plate 32 to conceal said portion from the view of a person on the other side of the lower bracket 28.

The anchor members 74 are inserted through a plurality of upper slots 26 in the vertical member side plates 24. To allow the upper bracket plate 68 to extend perpendicularly from the wall panel 10 and bear against the lower bracket plate 32, the edge portion 76 and anchor members 74 thereof extend at an angle relative to the plate 68 such that said edge portion and anchor members are aligned with the edge portion 36 and anchor members 34 of the lower bracket 28 and are perpendicular to the vertical member side plate 24. In addition, the edge portion 76 is preferably stepped from the vertical plate 68 of the upper bracket 30.

As best shown in FIGS. 14 and 15, the upper bracket anchor members 74 preferably comprise a neck portion 78 extending horizontally outward from an edge 80 of the upper bracket plate 68 and a head 82 extending outwardly from the neck portion 78. The head 82 has an upwardly extending hook portion 84 and a downwardly extending hook portion 86. The anchor members 74 can comprise only a downwardly extending hook portion 86, although the upwardly extending hook portion 84 is desirable to allow the upper bracket 30 to be inversely assembled to the lower bracket 28 and the opposite side plate 24 of the wall panel vertical member 12. The hook portions 84 and 86 have an inner edge 88 parallel to and spaced apart from the edge 80 of lower bracket plate 68, and the distance between the hook portion inner edges 88 and the edge 80 of the upper bracket plate 68 is approximately the same as the thickness of the vertical member side plate 24 to form a recess 89 which slideably receives the side plate 24.

Referring again to FIGS. 3-6, the upper bracket plate 68 also has an upper flange 90 extending horizontally outward from an upper edge thereof, a lower flange 92 extending horizontally outward from a lower edge thereof, and an elongated vertical opening 94 therein. The upper flange 90 provides a mounting surface for supporting a worksurface 96 or the like thereto (FIGS. 1 and 13), the lower flange 92 has an oversized hole therein (not shown) which receives the threaded fastener 64 for drawing the upper bracket 30 and lower bracket 28 together, and the elongated opening 94 receives the fastener 66 to secure the upper bracket 30 to the lower bracket 28. Preferably, the upper flange 90 also has an oversized hole therein for receiving the fastener 64 when the upper and lower brackets 30 and 28 are inverted and mounted to the opposite side plate 24 of vertical member 12.

Figure 9:
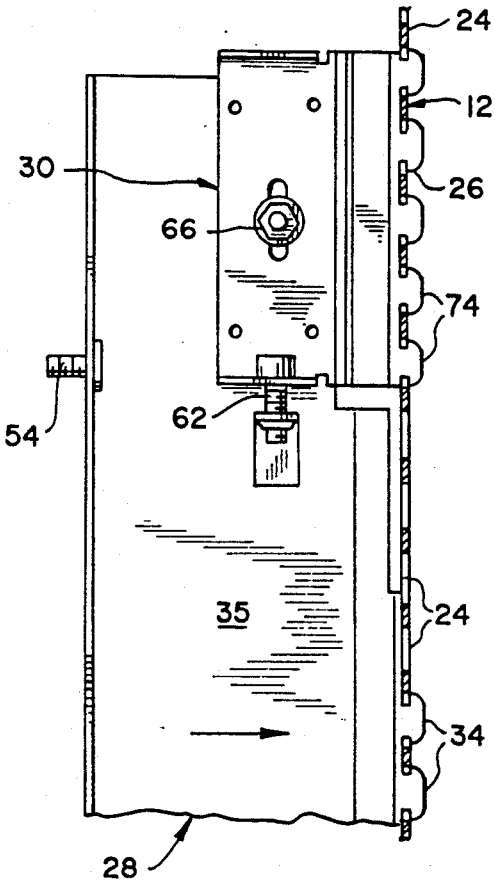
FIG. 9 is a fragmentary, exploded back view of the bracket assembly shown with the anchor members inserted into the vertical member slots.
Figure 10:
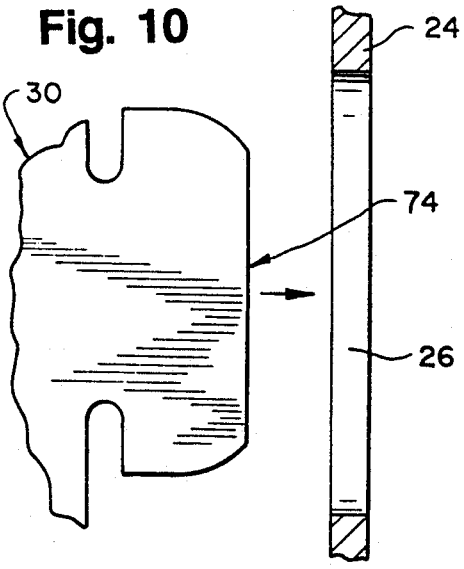
FIG. 10 is an exploded view of an upper bracket anchor member shown prior to insertion into the corresponding vertical member slot.
Figure 11:
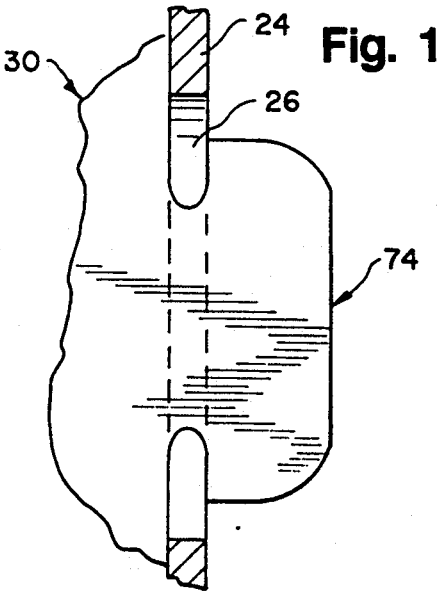
FIG. 11 is an exploded view of the upper bracket anchor member in FIG. 10 shown inserted into the corresponding vertical member slot.
Figure 12:
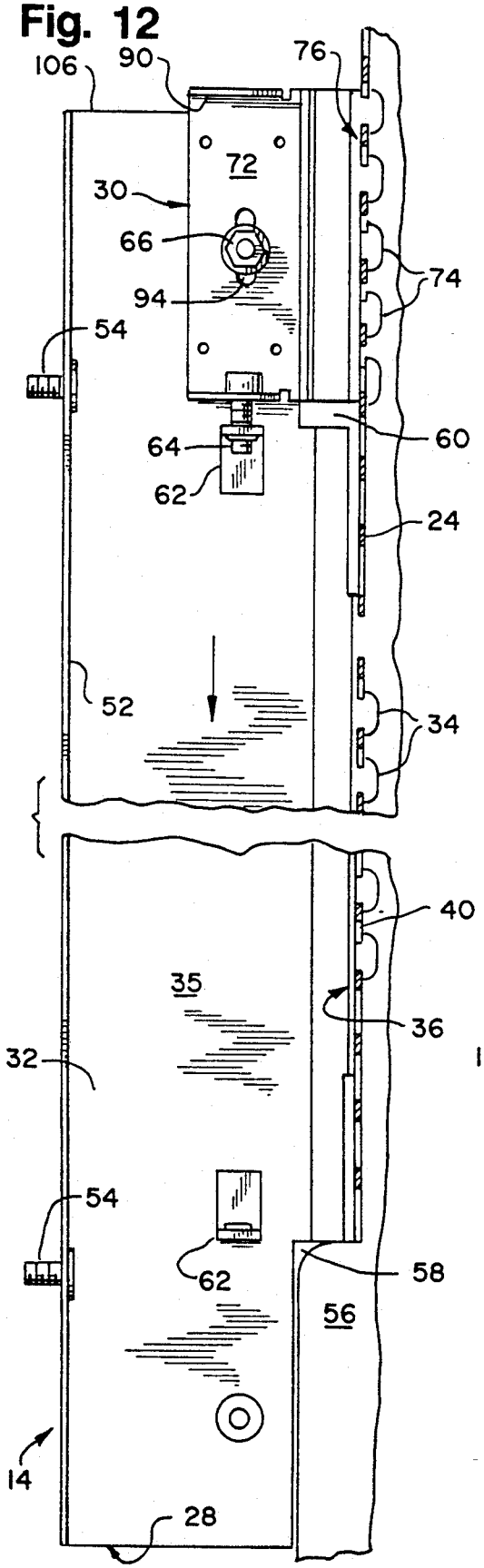
FIG. 12 is a fragmentary back view of the bracket assembly shown after the anchor members are inserted into the corresponding slots.
Figure 13:
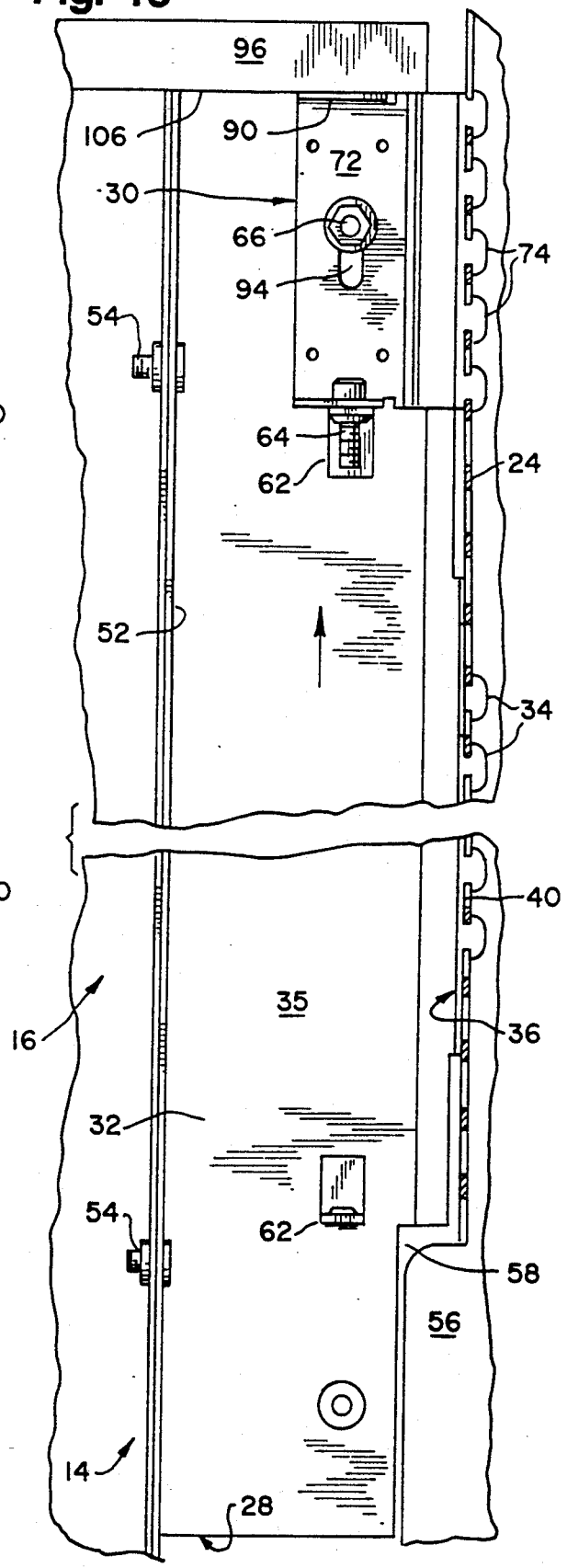
FIG. 13 is a fragmentary back view of a pedestal and worksurface mounted to the bracket assembly shown after locking means has pulled the lower bracket toward the upper bracket to secure the bracket assembly to the vertical member of the wall panel.

The operation of the bracket assembly 14 is illustrated in FIGS. 8-15. Prior to assembly, the fastener 66 is loosened to allow the upper bracket 30 to slide vertically relative to the lower bracket 28, and the fastener 62 is turned to a desired extended position (FIG. 8). As shown in FIG. 9, the lower bracket anchor members 34 are inserted into the corresponding lower slots 26, and the upper bracket anchor members 74 are inserted the corresponding slots 26. In FIGS. 12 and 14, the upper and lower brackets 28 and 30 are allowed to fall such that the vertical member side plate 24 is slideably received by the recesses 50 formed by the downwardly extending hook portions 46 of the lower bracket anchor members 34 and by the recesses 90 formed by the downwardly extending hook portions 86 of the upper bracket anchor members 74. As shown in FIGS. 13 and 15, the lower bracket 28 is pulled vertically upward toward the upper bracket 30 by turning the fastener 62. As a result, the vertical member side plate 24 is slideably received by the recess 50 formed by the upwardly extending hook portion 44 of the lower bracket anchor members 34. Thus, the upwardly extending hook portions 44 of the lower bracket anchor members 34 and the downwardly extending hook portions 86 of the upper bracket anchor members 74 prevent horizontal movement of the bracket assembly 14. Preferably, top edge portions 98 of the lower bracket anchor member necks 38 bear against top edges 100 of the lower slots 26, and bottom edge portions 102 of the upper bracket anchor member necks 78 bear against bottom edges 104 of the upper slots 26 to prevent vertical movement of the bracket assembly 14. The bracket assembly 14 is therefore securely mounted to the vertical member 12 and restrained from movement in any direction. Finally, the pedestal 16, support panel 20, or any other desirable support device is mounted to the flange 52 of the lower bracket 28 by the fasteners 54 such that a lower portion thereof rests on a floor to support the wall panels 10. Preferably, the upper flange 90 of the upper bracket 30 is substantially the same height as a top edge 106 of the lower bracket plate 32 after assembly.

The bracket assembly 14 can comprise a first bracket positioned in various locations relative to a second bracket as long as locking means are adapted to move at least one of the brackets relative to the other so that the respective anchor member hook portions bear against a portion of the vertical member 12. For example, the upper bracket 30 can be positioned adjacent a middle or lower portion of the lower bracket 28, and the respective anchor members can be placed in the same slots if enough clearance is provided. The locking means can also couple an upper portion of the upper bracket 30 to the lower bracket 28 when the upper bracket is in any position relative to the lower bracket. Furthermore, the brackets can be forced apart rather than drawn together to achieve the same result, and the locking means can comprise any suitable means for forcing the brackets together or apart, such as a spring, cam mechanism, or the like. The brackets can also be any size, the anchor members can be any shape which fits inside the corresponding apertures and cooperates with the vertical member of the wall panel when moved by the locking means, and the apertures and anchor members need not be vertically aligned as long as the position of the anchor members correspond with the position of the apertures.

Thus, an attractive bracket assembly is provided which is conveniently and securely mounted to a wall panel system so that worksurface can be attached thereto and a pedestal, support panel or the like can be securely attached thereto to provide a stable support for a wall panel system.

Although the present invention has been described with reference to preferred embodiments, workers skilled in the art will recognize that many changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. An apparatus for supporting a wall panel system comprising:

a wall panel;

a vertical member attached to the wall panel and having a plurality of spaced apart apertures therein;

a support member adapted to be attached to a bracket assembly and rest on a floor;

a bracket assembly external to the support member and adapted to interconnect the support member to the vertical member of the wall panel, said bracket assembly comprising a first bracket having a plurality of spaced apart anchor members extending outward therefrom for insertion into a plurality of corresponding apertures in the vertical member;

a second bracket having a plurality of spaced apart anchor members extending outward therefrom for insertion into corresponding apertures in the vertical member; and locking means adapted to move one of said brackets vertically toward the other such that said anchor members cooperate with the vertical member to secure the bracket assembly thereto, said locking means comprising a flange extending horizontally outward from one of said brackets, a tab extending horizontally outward from the other of said brackets, and a threaded fastener coupling said flange and tab, whereby the first and second brackets are pulled toward each other by turning the fastener, said first and second brackets and said locking means being external to the support member to facilitate the securing of the brackets to the vertical member and the installation and removal of the support member to one of said brackets.

2. The apparatus of claim 1, wherein the first bracket anchor members comprise a neck portion extending horizontally outward therefrom and a hook portion extending substantially perpendicularly from the neck portion, and the second bracket anchor members comprise a neck portion extending horizontally outward therefrom and a hook portion extending substantially perpendicularly from the neck portion in an opposite direction relative to the hook portion of the first bracket anchor members, said hook portions bearing against an inner surface of the vertical member when the locking means moves one of the brackets relative to the other to secure the bracket assembly to the vertical member.

3. The apparatus of claim 2, wherein said hook portions have an inner edge parallel to and spaced apart from an edge portion of the corresponding bracket, and the distance between said hook portion inner edges and the edge portion of the corresponding bracket being substantially the same as the thickness of the vertical member of the wall panel to form a recess which slideably receives said vertical member, whereby the anchor members are inserted into the corresponding slots, one of the brackets is moved relative to the other by the locking means, and the wall panel vertical member is slideably received by the anchor member recesses such that the anchor member hook portions prevent horizontal movement of the bracket assembly.

4. The apparatus of claim 2, wherein a portion of the anchor member necks bears against an edge of the corresponding aperture to prevent vertical movement of the bracket assembly, thus securing the bracket assembly to the vertical member of the wall panel.

5. The apparatus of claim 1, wherein the anchor members of the first bracket are vertically aligned and inserted into first corresponding, vertically aligned apertures in the vertical member of the wall panel, and the anchor members of the second bracket are vertically aligned and inserted into second corresponding, vertically aligned apertures in the vertical member of the wall panel.

6. The apparatus of claim 5, wherein the second apertures are vertically aligned with and positioned above the first apertures such that the anchor members of the second bracket are vertically aligned with the anchor members of the first bracket when inserted into said apertures.

7. The apparatus of claim 1, wherein a substantial portion of one of said brackets is adjacent one side of the other bracket.

8. The apparatus of claim 7, wherein a top edge of the second bracket is substantially the same height as a top edge of the first bracket after assembly thereof.

9. The apparatus of claim 1, wherein one of said brackets further comprises a horizontal flange extending outward from the top edge thereof for mounting a worksurface thereon.

10. An apparatus for supporting a wall panel system comprising:

a wall panel;

a vertical member having a plurality of vertically aligned, longitudinal slots therein;

a support member adapted to be attached to a bracket assembly and rest on a floor;

a bracket assembly external to the support member and adapted to interconnect the support member to the vertical member of the wall panel, said bracket assembly comprising a first bracket having a plurality of vertically aligned, spaced apart anchor members extending horizontally outward therefrom for insertion into first corresponding slots in the vertical member, said anchor members having a neck portion extending horizontally outward from said bracket and a hook portion extending substantially perpendicularly from the neck portion;

a second bracket having a plurality of vertically aligned, spaced apart anchor members extending horizontally outward therefrom for insertion into second corresponding slots in the vertical member, said anchor members having a neck portion extending horizontally outward from the second bracket and a hook portion extending substantially perpendicularly from said neck portion in an opposite direction relative to the hook portion of the first bracket anchor members, and a substantial portion of one of said brackets being adjacent one side of the other bracket to conceal said portion from the view of a person on the opposite side of said other bracket; and locking means adapted to move one of said brackets relative to the other in a vertical direction such that a portion of the hook members bears against the vertical member to secure said assembly to the wall panel vertical member, said first and second brackets and said locking means being external to the support member to facilitate the securing of the brackets to the vertical member and the installation and removal of the support member to one of said brackets, said locking means comprising a flange extending horizontally outward from the second bracket, a tab extending horizontally outward from the first bracket, and a threaded fastener coupling said flange and tab, whereby the first and second brackets are pulled vertically toward each other by turning the fastener.

11. The apparatus of claim 10, wherein the second corresponding slots are positioned above the first corresponding slots, whereby the anchor members of the second bracket are positioned above the anchor members of the first bracket.

12. The apparatus of claim 11, wherein the second bracket further comprises a horizontal flange extending outward from the top edge thereof for mounting a worksurface thereon.

13. The apparatus of claim 12, wherein the horizontal flange of the second bracket is substantially the same height as a top edge of the first bracket after assembly thereof.

14. The apparatus of claim 10, wherein the anchor member hook portions have an inner edge parallel to and spaced apart from an edge portion of the corresponding bracket, and the distance between said hook portion inner edges and the edge portion of the corresponding bracket being substantially the same as the thickness of the vertical member of the wall panel to form a recess which slideably receives said vertical member, whereby the anchor members are inserted into the corresponding slots, one of the brackets are moved relative to the other by the locking means, and the wall panel vertical member is slideably received by the anchor member recesses such that the anchor member hook portions prevent horizontal movement of the bracket assembly.

15. The apparatus of claim 10, wherein a portion of the anchor member necks bears against an edge of the corresponding aperture to prevent vertical movement of the bracket assembly, thus securing the bracket assembly to the vertical member of the wall panel.

16. An apparatus for supporting a wall panel system comprising:

a wall panel;

a vertical member having a plurality of vertically aligned, longitudinal slots therein;

a bracket assembly comprising a lower bracket including a vertical plate having a flange extending perpendicularly therefrom and a plurality of vertically aligned, spaced apart anchor members extending horizontally outward from a vertical edge portion thereof opposite said flange for insertion into corresponding lower slots in the vertical member of the wall panel, said vertical plate being substantially perpendicular to the wall panel, and said anchor members having a neck portion extending horizontally outward from the edge portion of the lower bracket plate and a hook portion extending upwardly from said neck portion;

an upper bracket including a vertical plate having a plurality of vertically aligned, spaced apart anchor members extending horizontally outward from a vertical edge portion thereof for insertion into corresponding upper slots in the vertical member of the wall panel, said anchor members having a neck portion extending horizontally outward from the edge portion of the upper bracket plate and a hook portion extending downwardly from the neck portion, and a substantial portion of the upper bracket plate being adjacent one side of the lower bracket plate to conceal said portion from the view of a person on the other side of the lower bracket;

said anchor members of the first and second brackets being vertically aligned;

locking means for pulling the upper and lower brackets vertically toward each other such that a portion of the hook members bears against an inner surface of the vertical member to secure the bracket assembly to the wall panel vertical member; and a support member adapted to rest on a floor and be attached to the flange of the lower bracket to securely support the wall panel.

17. The apparatus of claim 16, wherein bottom edge portions of the upper bracket anchor member necks bear against bottom edges of the upper slots, and top edge portions of the lower bracket anchor member necks bear against top edges of the lower slots to prevent vertical movement of the brackets and secure the bracket assembly to the vertical member.

18. The apparatus of claim 16, wherein the hook portions have an inner edge parallel to and spaced apart from the edge portion of the corresponding bracket plate, and the distance between said hook portion inner edges and the edge portion of the corresponding bracket plate are substantially the same as the thickness of the vertical member of the wall panel to form a recess which slideably receives said vertical member, whereby the anchor members are inserted into the corresponding slots, the upper and lower brackets are pulled vertically toward each other by the locking means, and the wall panel vertical member is slideably received by the anchor member recesses such that the anchor member hook portions prevent horizontal movement of the bracket assembly.

19. The apparatus of claim 16, wherein the upper bracket further comprises a horizontal flange extending outward from the top edge of the plate for mounting a worksurface thereon.

20. The apparatus of claim 19, wherein the horizontal flange of the upper bracket plate is substantially the same height as a top edge of the lower bracket after assembly.

21. The apparatus of claim 16, wherein the upper bracket plate has an elongated vertical opening therein for receiving a fastener to secure the upper bracket plate to the lower bracket plate.

22. The apparatus of claim 16, wherein the locking means comprises a flange extending horizontally outward from a lower edge of the upper bracket vertical plate, a tab extending horizontally outward from the lower bracket vertical plate, and a threaded fastener coupling said flange and tab, whereby the upper and lower brackets are pulled toward each other by turning the fastener.

* * * * *

UNITED STATES PATENT AND TRADEMARK OFFICE

CERTIFICATE OF CORRECTION

PATENT NO. 5,230,492

DATED July 27, 1993

INVENTOR(S) Donald A. Zwart et al.

It is certified that error appears in the above-indentified patent and that said Letters Patent is hereby corrected as shown below:

In column 3, line 28, delete "12A" and substitute --12C--.

In column 5, line 51, after "inserted" insert --into--.

Signed and Sealed this

Twenty-second Day of November, 1994

*Attest:*

Bruce Lehman

BRUCE LEHMAN

*Attesting Officer*

*Commissioner of Patents and Trademarks*